US009268265B2

(12) United States Patent
Ai

(10) Patent No.: US 9,268,265 B2
(45) Date of Patent: Feb. 23, 2016

(54) IMAGE FORMING APPARATUS

(71) Applicant: CANON KABUSHIKI KAISHA, Tokyo (JP)

(72) Inventor: Ryuta Ai, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/716,178

(22) Filed: May 19, 2015

(65) Prior Publication Data

US 2015/0338784 A1 Nov. 26, 2015

(30) Foreign Application Priority Data

May 21, 2014 (JP) ..... 2014-104901

(51) Int. Cl.
*G03G 15/00* (2006.01)
*G03G 15/16* (2006.01)

(52) U.S. Cl.
CPC ..... *G03G 15/161* (2013.01)

(58) Field of Classification Search
CPC . G03G 15/161; G03G 15/5012; G03G 15/70; G03G 2215/00556; G03G 2215/00945
USPC ..... 399/85, 20, 23
See application file for complete search history.

(56) References Cited

U.S. PATENT DOCUMENTS

| | | | | |
|---|---|---|---|---|
| 6,567,620 | B2 | 5/2003 | Brown, Jr. et al. | |
| 7,251,433 | B2 | 7/2007 | Ai et al. | |
| 7,668,478 | B2 | 2/2010 | Ai | |
| 8,095,032 | B2 | 1/2012 | Torimaru et al. | |
| 8,135,303 | B2 | 3/2012 | Ai et al. | |
| 8,224,199 | B2 | 7/2012 | Ai | |
| 2008/0084020 | A1 * | 4/2008 | Nakamura | B41J 11/485 270/1.01 |
| 2013/0058663 | A1 * | 3/2013 | Yano | G03G 15/502 399/16 |

FOREIGN PATENT DOCUMENTS

| | | | | |
|---|---|---|---|---|
| JP | 7-121080 | A | | 5/1995 |
| JP | 2004175043 | A | * | 6/2004 |
| JP | 2006-146189 | A | | 6/2006 |
| JP | 2007-233276 | A | | 9/2007 |
| JP | 2009-025474 | A | | 2/2009 |
| JP | 2010036362 | A | * | 2/2010 |

* cited by examiner

*Primary Examiner* — Billy Lactaoen
(74) *Attorney, Agent, or Firm* — Fitzpatrick, Cella, Harper & Scinto

(57) ABSTRACT

An image forming apparatus includes: an intermediary transfer member (belt); first and second accommodating portions; a detecting member; an executing portion for executing a removing operation for removing the toner image transferred on the belt by once interrupting a continuous job for continuously forming an image on the recording material fed from the first accommodating portion when discrimination that there is no recording material in the first accommodating portion is made on the basis of a detection result of the detecting member during the continuous job and then for executing a switching operation for resuming the continuous job by feeding the recording material from the second accommodating portion; and a setting portion for setting a moving speed of the belt during execution of the removing operation so as to be higher than a moving speed of the belt when the toner image is transferred onto the recording material.

8 Claims, 7 Drawing Sheets

IMAGE FORMING APPARATUS

FIELD OF THE INVENTION AND RELATED ART

The present invention relates to an image forming apparatus for forming an image on a recording material.

An image forming apparatus of an intermediary transfer type in which a toner image formed on an image bearing member is transferred onto an intermediary transfer member and then is transferred from the intermediary transfer member onto a recording material by a transfer device has been widely used.

In the image forming apparatus capable of continuously forming an image in a large amount, a plurality of accommodating portions such as a recording material cassette or the like for accommodating the recording material and for feeding the recording material to the transfer device for transferring the toner image are provided and when there is no recording material in a first accommodating portion, the accommodating portion is automatically changed from the first accommodating portion to a second accommodating portion and then the recording material is fed to a toner image transfer portion. In this case, when the accommodating portion is switched to the second accommodating portion after the number of sheets of the recording material remaining in the first accommodating portion becomes 0, feeding of the recording material to the transfer device is not in time, so that the toner image which has already been formed on the image bearing member and is transferred on the intermediary transfer member cannot be transferred onto the recording material in some instances.

In U.S. Pat. No. 6,567,620, when the number of sheets of the recording material remaining in the first accommodating portion is below a predetermined amount, a toner image forming interval is increased, and therefore the feeding of the recording material from the second accommodating portion is in time by switching the accommodating portion to the second accommodating portion after the number of sheets of the recording material remaining in the first accommodating portion becomes 0. For this reason, the toner image formed on the image bearing member and then transferred on the intermediary transfer member is transferred onto the recording material with reliability, so that generation of the toner image which cannot be transferred from the intermediary transfer member onto the recording material is prevented. However, the toner image forming interval is increased, and therefore productivity of image formation is remarkably lowered.

In Japanese Laid-Open Patent Application Hei 7-121080, when the number of sheets of the recording material remaining in the first accommodating portion is below a predetermined amount, at that time, feeding of the recording material from the second accommodating portion is started to ensure the feeding of the recording material to the toner image transfer portion with an interruption. However, the accommodating portion is switched to the second accommodating portion in a state in which the recording material is left in the first accommodating portion, and therefore the recording material in the first accommodating portion cannot be used up.

Therefore, such a method that when there is no recording material in the first accommodating portion after the toner image is continuously formed on the image bearing member and then continuously transferred onto the intermediary transfer member with high productivity, toner image formation is stopped and then the toner image which cannot be transferred onto the recording material is removed by an intermediary transfer member cleaning device has been studied. Then, at timing when the feeding of the recording material from the second accommodating portion to the transfer device is ensured with reliability, the image formation is resumed.

However, in order to collect a large amount of the toner (toner image) on the intermediary transfer member which cannot be transferred onto the recording material, there is a need to interrupt the image formation and to idle the intermediary transfer belt, causing a delay in resuming the image formation.

Particularly, the intermediary transfer member cleaning device is of a so-called electrostatic cleaning type in order to collect a large amount of the toner which cannot be transferred onto the recording material, so there is a need to idle the intermediary transfer member for a long time. As a result, a downtime in which the image formation is interrupted is increased, causing productivity of the image forming apparatus to be remarkably lowered.

SUMMARY OF THE INVENTION

According to an aspect of the present invention, there is provided an image forming apparatus comprising: a movable intermediary transfer member onto which a toner image to be transferred onto a recording material is once transferred; first and second accommodating portions for accommodating the recording material; a detecting member for detecting the recording material in the first accommodating portion; an executing portion for executing a removing operation for removing the toner image transferred on the intermediary transfer member by once interrupting a continuous job for continuously forming an image on the recording material fed from the first accommodating portion when a discrimination that there is no recording material in the first accommodating portion is made on the basis of a detection result of the detecting member during the continuous job and then for executing a switching operation for resuming the continuous job by feeding the recording material from the second accommodating portion; and a setting portion for setting a moving speed of the intermediary transfer member during execution of the removing operation so as to be higher than a moving speed of the intermediary transfer member when the toner image is transferred onto the recording material.

These and other objects, features and advantages of the present invention will become more apparent upon a consideration of the following description of the preferred embodiments of the present invention taken in conjunction with the accompanying drawings.

First 6 is a time chart of control for executing an operation in a use-up mode with one-side printing mode.

Figure 7:
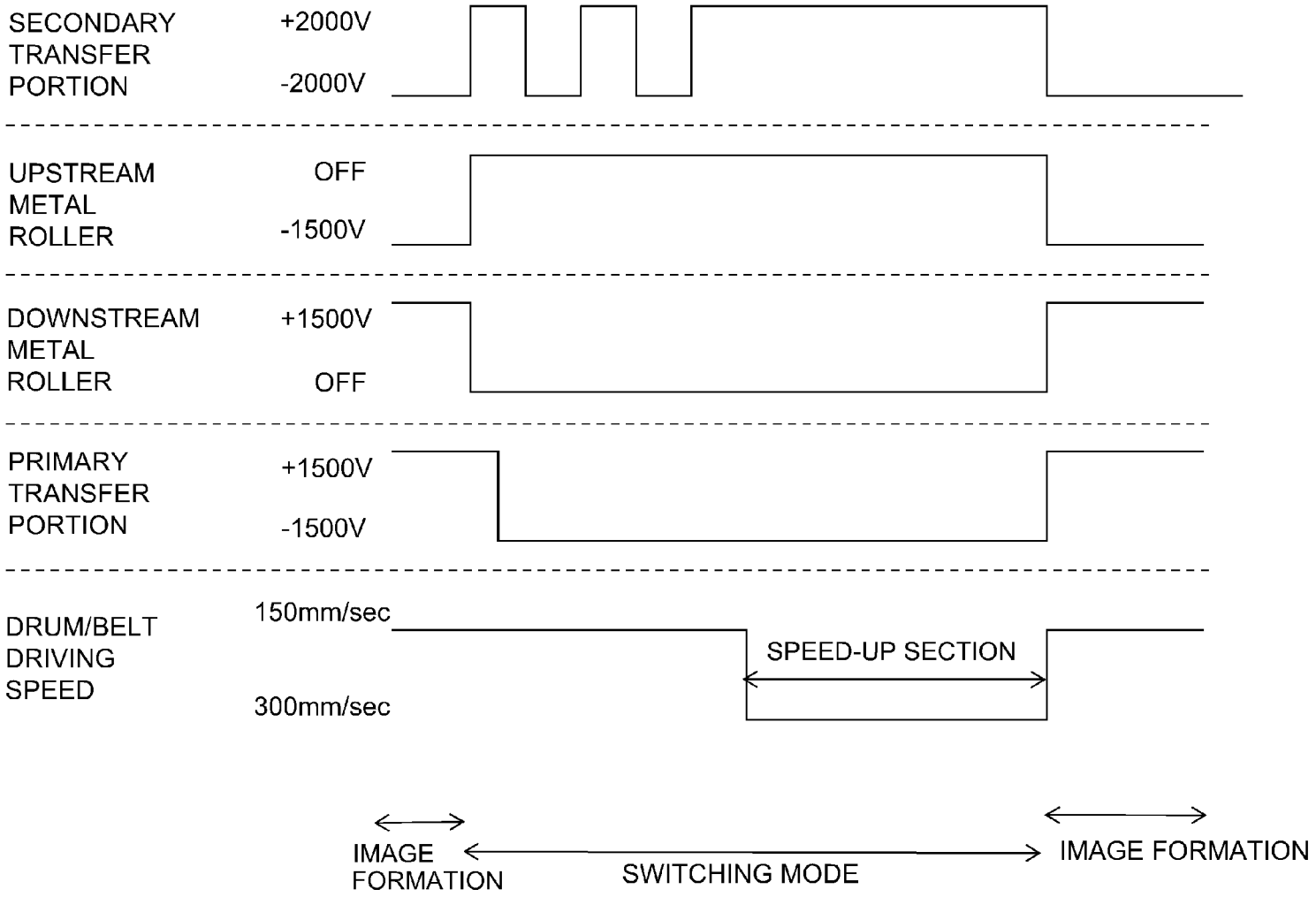

FIG. 7 is a time chart of control for executing an operation in a use-up mode with double-side printing mode.

DESCRIPTION OF THE EMBODIMENTS

Embodiments of the present invention will be described in detail with reference to the drawings.

Embodiment 1

(Image Forming Apparatus)

Figure 1:
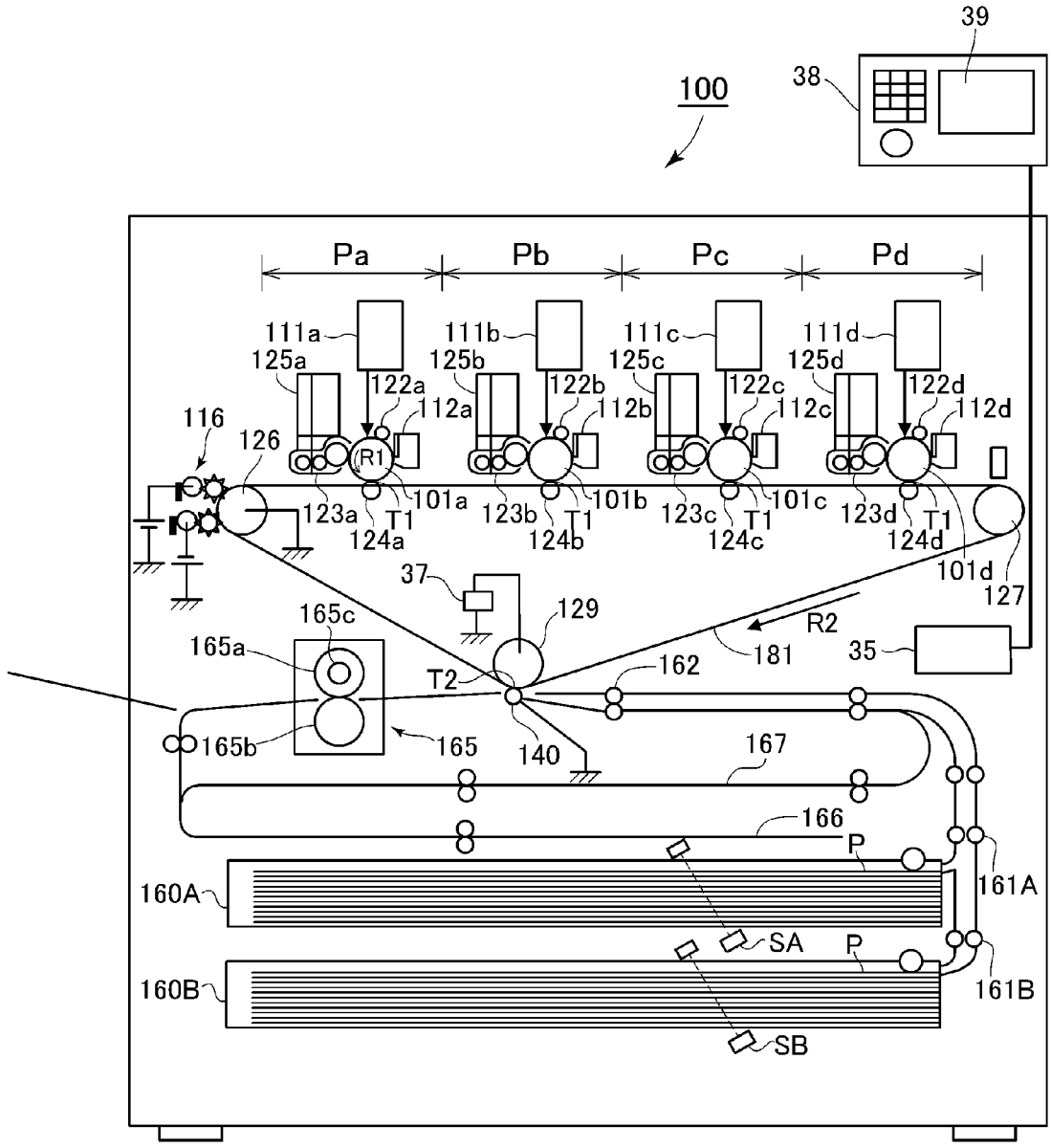
FIG. 1 is an illustration of a structure of an image forming apparatus.

FIG. 1 is an illustration of a structure of an image forming apparatus 100. As shown in FIG. 1, the image forming apparatus 100 is an intermediary transfer-type full-color printer of a tandem type in which image forming portions Pa, Pb, Pc and Pd are provided and arranged along an intermediary transfer belt 181.

At the image forming portion Pa, a yellow toner image is formed on a photosensitive drum 101*a* and is transferred onto the intermediary transfer belt 181. At the image forming portion Pb, a magenta toner image is formed on a photosensitive drum 101*b* and is transferred onto the intermediary transfer belt 181. At the image forming portions Pc and Pd, a cyan toner image and a black toner image are formed on photosensitive drums 101*c* and 101*d*, respectively, and are transferred onto the intermediary transfer belt 181.

The four color toner images transferred on the intermediary transfer belt 181 are fed to a secondary transfer portion T2, and are secondary-transferred onto a recording material P. The recording material P is fed from a recording material cassette 160A and is separated one by one by a separating roller pair 161A, and then is sent to a registration roller pair 162. The registration roller pair 162 sends the recording material P to the secondary transfer portion T2 while timing the recording material P to the toner images on the intermediary transfer belt 181.

A secondary transfer roller 140 contacts the intermediary transfer belt 181 supported by a secondary transfer inner roller 129 at an inside surface of the intermediary transfer belt 181, thus forming the secondary transfer portion T2. The secondary transfer roller 140 is connected to the ground potential, and a secondary transfer voltage output portion 37 applies, to the secondary transfer inner roller 129, a DC voltage of an opposite polarity to a charge polarity of the toners, so that the toner images are secondary-transferred from the intermediary transfer belt 181 onto the recording material P. To the secondary transfer inner roller 129, a higher voltage of, e.g., −2000 V is applied with a higher resistance value of the recording material or a larger thickness of the recording material.

The recording material P on which the four color toner images are secondary-transferred is curvature-separated from the intermediary transfer belt 181 at an exit of the secondary transfer portion T2 and then is sent into a fixing device 165, in which the toner images are heated and pressed and are thus fixed on the recording material P. The fixing device 165 applies predetermined pressure and heat quantity to the toner images on the recording material P at a nip formed by a fixing roller 165*a* including a heater 165*c* and a pressing roller 165*b*, thus melt-fixing the toner images on the recording material P.

In the case of one-side printing mode, the recording material on which the image is fixed by the fixing device 165 is discharged as it is to an outside of the image forming apparatus 100. On the other hand, in double-side printing mode, the recording material on which the image is fixed by the fixing device 165 is sent into a reverse feeding path 166 in which the recording material is switched back to replace a leading end with a trailing end, thus being turned upside down. The recording material turned upside down is fed again to the registration roller pair 162 through the reverse feeding path 166 and a feeding path 167 for double-side printing, and then is sent to the secondary transfer portion T2 by the registration roller pair 162, so that the toner images are transferred onto a back (second) surface of the recording material. The recording material curvature-separated from the intermediary transfer belt 181 at the exit of the secondary transfer portion T2 is discharged to the outside of the image forming apparatus 100 after the toner images are fixed on the back surface of the recording material.

(Image Forming Portion)

The image forming portions Pa, Pb, Pc and Pd have substantially the same constitution except that colors of the toners used in developing devices 123*a*, 123*b*, 123*c* and 123*d* are yellow, magenta, cyan and black, respectively, which are different from each other. In the following, the image forming portion Pa will be described, and after image forming portions Pb, Pc and Pd will be omitted from redundant description.

In the image forming portion Pa, at a periphery of the photosensitive drum 101*a*, a charging device 122*a*, an exposure device 111*a*, the developing device 123*a*, a primary transfer roller 124*a* and a drum cleaning device 112*a* are provided.

The photosensitive drum 101*a* is prepared by forming a photosensitive layer on an outer peripheral surface of an aluminum cylinder of 80 mm in diameter by applying a layer of an organic photoconductor (OPC). The photosensitive drum 101*a* is rotatably supported at end positions thereof, and to one of the end portions, a driving force is transmitted from an unshown driving motor, so that the photosensitive drum 1*a* is rotated in an arrow R1 direction at a predetermined image forming speed.

The charging device 122*a* electrically charges the photosensitive drum 101*a* to a uniform negative polarity potential by using a charging roller. The charging roller is rotatably supported by unshown bearing members at end portions of a core metal thereof, and is press-contacted to the surface of the photosensitive drum 101*a* by being urged by unshown urging springs, thus being rotated by rotation of the photosensitive drum 101*a*. To the core metal of the charging roller, from an unshown high-voltage source, an oscillating voltage in the formed of a DC voltage (Vdc) biased with an AC voltage (Vac) is applied. Specifically, the oscillating voltage is a sine wave consisting of the DC voltage of −500 V and the AC voltage of 1 kHz in frequency (f) and 1.5 kV in peak-to-peak voltage (Vpp). As a result, the peripheral surface of the photosensitive drum 101*a* is charged to a dark-portion potential Vd of −500 V.

The exposure device 111*a* scans the surface of the photosensitive drum 101*a* with a laser beam, through a rotating mirror, generated on the basis of an image signal developed from image data into scanning lines, so that an electrostatic image for an image is written (formed) on the surface of the photosensitive drum 101*a*. The exposure device 111*a* is controlled so that a semiconductor laser element is turned on depending on the image signal by an unshown laser driving circuit.

The developing device 123*a* develops the electrostatic image into the toner image by transferring a negative charged toner onto the electrostatic image on the photosensitive drum 101*a*. The developing device 123*a* carries a developer containing a toner and a carrier on a developing sleeve in an erected state of a chain thereof and rubs the photosensitive drum 101*a* with the developer. An unshown developing device applies, to the developing sleeve, an oscillating voltage in the form of a negative DC voltage biased with an AC voltage. As a result, the toner is transferred from the developing sleeve onto the photosensitive drum 101*a*, so that the electrostatic image is developed into the toner image. A developer supplying portion 125*a* supplies developer to the developing device 123*a* in an amount corresponding to the toner taken out from the developing device 123*a* with the image formation.

The primary transfer roller 124*a* urges the intermediary transfer belt 181 to form a primary transfer portion between the photosensitive drum 101*a* and the intermediary transfer belt 181. An unshown transfer voltage source applies a positive DC voltage to the primary transfer roller 124*am*, so that the toner image is transferred from the photosensitive drum 101*a* onto the intermediary transfer belt 181.

The drum cleaning device 112*a* collects a transfer residual toner deposited on the surface of the photosensitive drum 101*a* by rubbing the photosensitive drum 101*a* with a cleaning blade. As the cleaning blade, an urethane rubber blade bonded to a metal plate is used and is 75° in Asker hardness and 30 gf/cm in contact pressure to the photosensitive drum 101*a*.

(Intermediary Transfer Belt)

Figure 2:
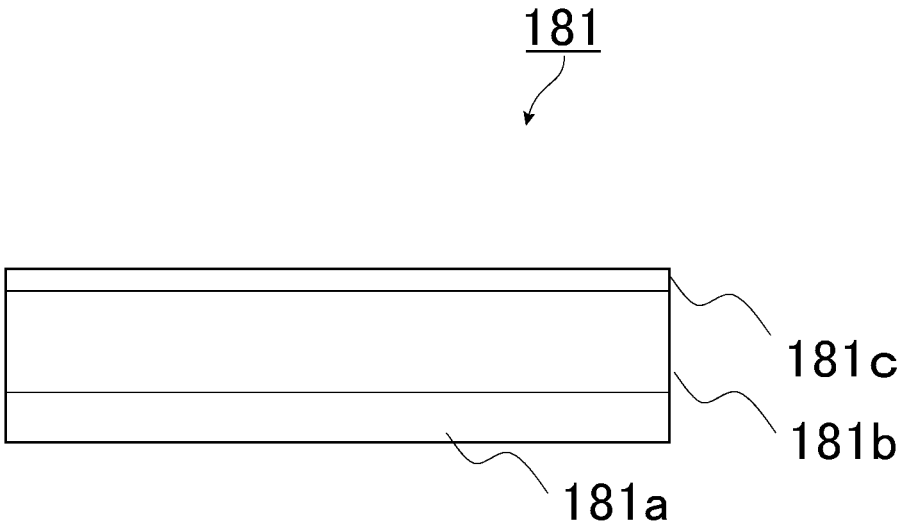
FIG. 2 is a sectional view of an intermediary transfer belt.

FIG. 2 is a sectional view of the intermediary transfer belt 181. As shown in FIG. 1, the intermediary transfer belt 181 is an endless elastic belt of 2400 mm in circumferential length. The intermediary transfer belt 181 is stretched by a driving roller 127, a tension roller 126 and a secondary transfer inner roller 129. The driving roller 127 is driven by an unshown motor to rotationally drive the intermediary transfer belt 181 in an arrow R2 direction. The tension roller 126 is urged by using springs at end portions thereof, and applies a substantially constant tension of about 20-50 N (2-5 kgf) to the intermediary transfer belt 181.

As shown in FIG. 2, the intermediary transfer belt 181 is prepared by laminating a 20-200 μm thick elastic layer 181*b* of an elastic material on a 70 μm-thick base layer 181*a* of a resin material. The surface of the elastic layer 181*b* is coated with a 5-10 μm thick surface layer 181*c* of a fluorine-containing resin material.

The resin material for the base layer 181*a* is polyimide, polycarbonate and the like. As the elastic material for the elastic layer 181*b*, it is possible to use one or two or more species of material selected from the group consisting of elastic material rubbers and elastomers, such as butadiene rubber, fluorine-containing rubber, acrylic rubber, EPDM and NBR. Elastic materials other than these materials may also be used. The surface layer 181*c* can use a resin material such as polyurethane, polyester, epoxy resin and fluorine-containing resin. The surface layer decreases a depositing force of the toner on the surface of the intermediary transfer belt 181, thus facilitating the transfer of the toner onto the recording material P at the secondary transfer portion T2. The intermediary transfer belt 181 is adjusted to have a volume resistivity of $1\times10^{9}$-$1\times10^{14}$ Ω/cm by incorporating carbon black into each of the layers.

The image forming apparatus 100 is required to individually meet diversifying recording material species. In order to improve a transfer property onto such a recording material that has an uneven surface layer, the intermediary transfer belt 181 including the elastic layer 181*b* is employed. The intermediary transfer belt 181 is soft since it includes the elastic layer 181*b*, and can reduce a pressure acting on the toner image at the secondary transfer portion T2. For this reason, such an intermediary transfer belt 181 has an effect on not only improvement in transfer property onto general-purpose paper but also transfer property onto thick paper and paper having unevenness.

The intermediary transfer belt 181 includes the soft elastic layer 181*b*, and therefore in a conventional blade cleaning device using the cleaning blade, a friction resistance becomes large. For this reason, in order to collect the toner from the intermediary transfer belt 181 in a downstream side of the secondary transfer portion T2, a belt cleaning device 116 of an electrostatic fur brush type in which the toner is collected electrostatically by rubbing the intermediary transfer belt 181 with a fur brush is employed.

(Belt Cleaning Device)

Figure 3:
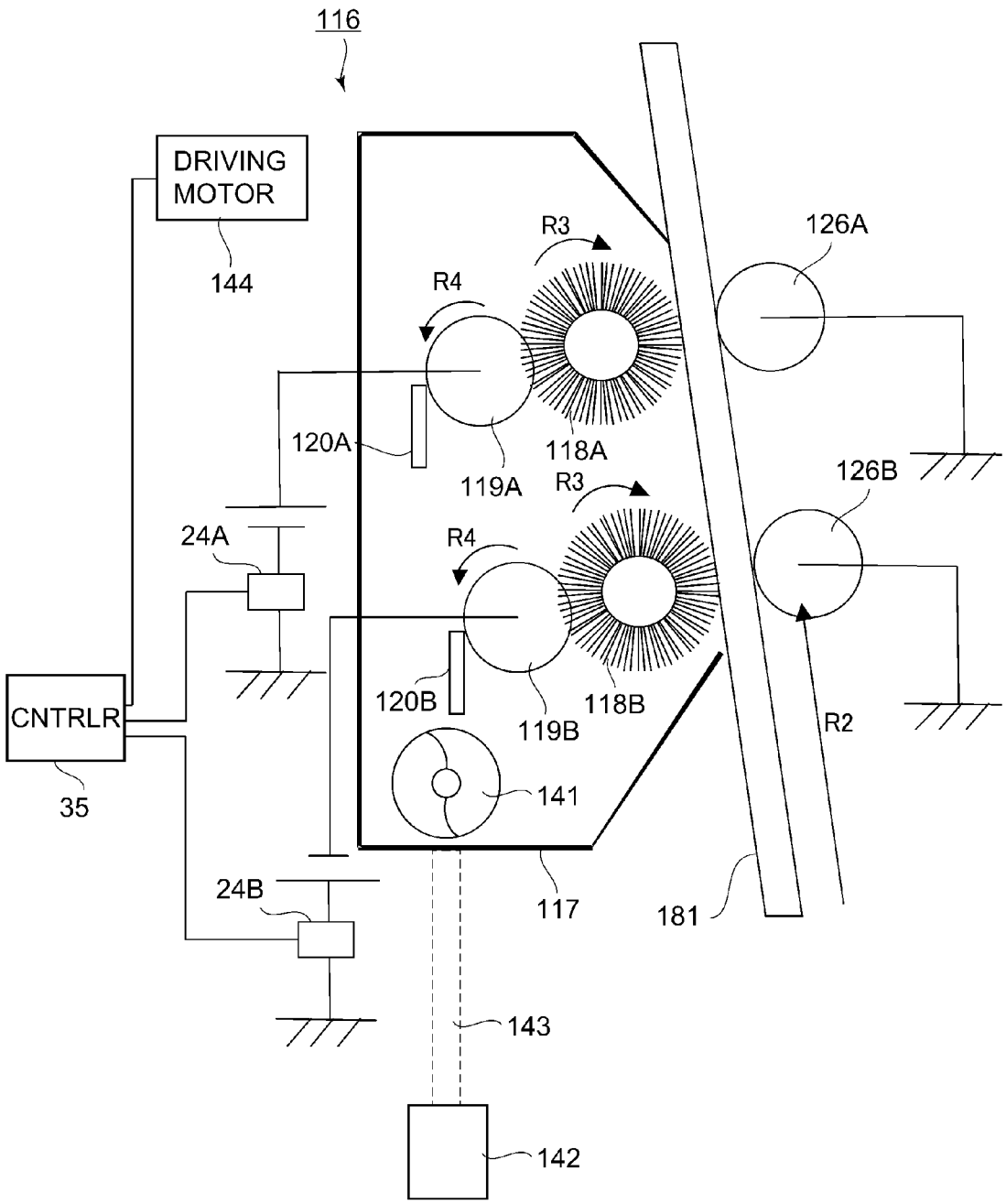
FIG. 3 is an illustration of a structure of a belt cleaning device.

FIG. 3 is an illustration of a structure of the belt cleaning device 116. As shown in FIG. 1, the belt cleaning device 116 removes electrostatically the transfer residual toner which passed through the secondary transfer portion T2 and which remains on the intermediary transfer belt 181.

As shown in FIG. 3, the belt cleaning device 116 is an electrostatic belt cleaning device for collecting electrostatically the toner triboelectrically charged by rubbing the surface of the intermediary transfer belt 181 with fur brushes 118A and 118B to which a DC voltage is applied. The belt cleaning device 116 includes, inside a housing 117 provided in the neighborhood of the intermediary transfer belt 181, the fur brushes 118A and 118B, metal rollers 119A and 119B and cleaning blades 120A and 120B.

Each of the fur brushes 118A and 118B is $0.3\times10^{6}$ Ω/cm in resistance of fibers of the brush and 6 deniers in thickness of the fibers. Each of the fur brushes 118A and 118B is prepared by plating carbon black-dispersed nylon fibers on a core metal roller at a fiber-plating density of 500,000 fibers/inch$^2$. Each of the fur brushes 118A and 118B is disposed with a penetration amount of about 1.0 mm in the intermediary transfer belt 181, and is driven by a driving motor 144, thus being rotated in an arrow R3 direction at a peripheral speed of 50 mm/sec.

The metal rollers 119A and 119B are provided in contact with the fur brushes 118A and 118B, respectively, and are an aluminum roller having a mirror-finished surface. Each of the metal rollers 119A and 119B is disposed with a penetration amount of about 1.0 mm in the associated fur brush 118A or 118B, and is driven by the driving motor 144, thus being rotated in an arrow R4 direction at a peripheral speed equal to the peripheral speed of the fur brushes 118A and 118B.

Cleaning voltage output portions 24A and 24B detect values of currents flowing into the metal rollers 119A and 119B, respectively, on real time, and effect constant-current control for controlling an output voltage so that each of the detected current values coincides with a predetermined value determined by a controller 35.

Each of the cleaning blades 120A and 120B is an urethane blade disposed with a penetration amount of 1.0 mm in the associated metal roller 119A or 119B. A feeding screw 141 feeds the toner, to one of longitudinal end portions of the belt cleaning device 116, collected from the metal rollers 119A and 119B into the housing 117 by the cleaning blades 120A and 120B. The toner collected at the one of longitudinal end portions of the belt cleaning device 116 is accumulated in a collecting container 142 via a discharging pipe 143.

The cleaning voltage output portion 24B applies a negative DC voltage to the metal roller 119B. In this embodiment, a DC voltage of −1500 V was applied to the metal roller 119B. When the negative DC voltage is applied to the metal roller 119B, a potential difference is generated between the fur brush 118B and the intermediary transfer belt 181, so that the positively charged toner in the transfer residual toner on the intermediary transfer belt 181 is attracted to the fur brush 118B. The metal roller 119B electrostatically collects the positively charged toner from the fur brush 118B. The cleaning blade 120B scrapes off the toner deposited on the metal roller 119B into the housing 117.

Incidentally, even when the positively charged toner on the intermediary transfer belt 181 is removed by the fur brush 118B, an uncharged toner and the negatively charged toner remain on the intermediary transfer belt 181. Of these toners, the uncharged toner is negatively charged by generating electric discharge under application of the negative voltage to the fur brush 118B.

Further, the negatively charged toner remaining on the intermediary transfer belt 181 is transferred from the intermediary transfer belt 181 onto the fur brush 118A disposed in the downstream side by applying a positive voltage to the fur brush 118A, thus being removed from the intermediary transfer belt 181.

The cleaning voltage output portion 24A applies a positive DC voltage to the metal roller 119A. In this embodiment, a DC voltage of +1500 V was applied to the metal roller 119A. When the positive DC voltage is applied to the metal roller 119A, a potential difference is generated between the fur brush 118A and the intermediary transfer belt 181, so that the negatively charged toner in the transfer residual toner on the intermediary transfer belt 181 is attracted to the fur brush 118A. The metal roller 119A electrostatically collects the negatively charged toner from the fur brush 118A. The cleaning blade 120A scrapes off the toner deposited on the metal roller 119A into the housing 117.

As described above, the image forming portion Pa which is an example of a toner image forming unit forms the toner image. The intermediary transfer belt 181, which is an example of the intermediary transfer member, moves in contact with the image forming portion Pa. The primary transfer roller 124*a* which is an example of a first transfer member transfers the toner image from the image forming portion Pa onto the intermediary transfer belt 181 at the primary transfer portion T1. The secondary transfer roller 140 which is an example of a secondary transfer transfers the toner image from the intermediary transfer belt 181 onto the recording material at the secondary transfer portion T2. The fur brushes 118A and 118B are disposed downstream of the secondary transfer portion T2 and upstream of the image forming portion Pa with respect to a movement direction of the intermediary transfer belt 181 and contacts the intermediary transfer belt 181. The fur brush 118A collects the transfer residual toner during the image formation under application of the positive voltage thereof.

(Recording Material Accommodating Portion)

In recent years, technical development for POD (printing on demand) markets requiring image quality improvement, speed-up and a high-degree of stabilization using the intermediary transfer belt in an electrophotographic process has been actively made. The image forming apparatus for the POD markets is a system capable of quickly obtaining an image output product by only the amount needed when a user needs the image, and has already been in common in the printing markets. The image forming apparatus for the POD markets has an automatic cassette change (ACC) function.

As shown in FIG. 1, the image forming apparatus 100 has the automatic cassette change function. The automatic cassette change function is such a function that in the case where there is no recording material accommodated in a recording material cassette during continuous image formation, the recording material cassette is automatically switched to another recording material cassette to start feeding of the recording material and thus the image formation is continued.

In each of the recording material cassettes 160A and 160B, the recording materials having the same species and the same size are accommodated. The recording material cassette 160A is provided with a recording material sensor SA for detecting transmitted light for the recording material. The recording material cassette 160B is provided with a recording material sensor SB for detecting transmitted light for the recording material. Each of the recording material sensors SA and SB outputs an output signal capable of discriminating, depending on a transmitted light level, (1) a state in which the recording material is completely used up, (2) a state in which a remaining amount of the recording material is below a predetermined threshold, and (3) a state in which the remaining amount of the recording material exceeds the predetermined threshold.

The controller 35 discriminates that the paper (recording material) is ended (used up) when the recording material sensor SA does not detect the recording material, and then the switches the recording material cassette to the recording material cassette 160B to continue the feeding of the recording material, and provides warning of paper end (use-up of the recording material) in the recording material cassette 160A.

An image feeding distance from timing of writing (forming) the electrostatic image on the photosensitive drum 101*a* until the toner image is transferred onto the recording material at the secondary transfer portion T2 is Lg. An image transfer time from the timing of writing the electrostatic image on the photosensitive drum 101*a* until the recording material is transferred onto the recording material at the secondary transfer portion T2 is Tg. A recording material feeding time from start of feeding of the recording material by the recording material cassette 160A until the recording material actually reaches the secondary transfer portion T2 is Tp.

The image forming apparatus 100 is long in image feeding distance Lg since the intermediary transfer belt 181 is used and therefore is also long in image transfer time Tg. Further, in the case where the image transfer time Tg is longer than the recording material feeding time Tp, until the feeding of the recording material from the recording material cassette 160A is started, one or more toner images is formed on the photosensitive drum 101*a* and then is transferred onto the intermediary transfer belt 181.

For this reason, at the instance when the final recording material is fed from the recording material cassette 160A, even when the formation of the toner image at the image forming portion Pa is stopped, the toner image to be transferred onto a subsequent recording material has already been carried on the intermediary transfer belt 181 and is fed toward the secondary transfer portion T2. In other words, at the instance when the recording material sensor SA does not detect the recording material in the recording material cassette 160A, even when the recording material can be detected by switching the recording material cassette to the recording material cassette 160B, the toner image has already reached the secondary transfer portion T2 and therefore the recording material cannot reach the secondary transfer portion T2 in time.

Incidentally, if the number of sheets remaining in the recording material cassette 160A can be known on a one-sheet basis, the recording material can be caused to reach the secondary transfer portion T2 in time by starting the feeding of the recording material from the recording material cassette 160B before the final recording material is fed from the recording material cassette 160A. However, it is difficult to know the number of sheets in the recording material cassette 160A on the one-sheet basis with respect to the recording materials having various thickness.

Therefore, in the image forming apparatus 100 in a state in which the toner image formation is stopped, a rotational speed of the intermediary transfer belt 181 in a period in which the intermediary transfer belt 181 is rotated and then the toner image is collected is made higher than a rotational speed of the intermediary transfer belt 181 during the image formation. No recording material is detected when a feeding operation of the recording material cassette 160A in use is automatically changed to a feeding operation of the recording material cassette 160B, and then after the recording material cassette is switched to the recording material cassette 160B, the rotational speeds of the image forming portion and the intermediary transfer belt are made higher than those during the image formation. As a result, the downtime with the automatic cassette change (ACC) is remarkably reduced.

As described above, each of the recording material cassettes 160A and 160B which are examples of first and second accommodating portions, respectively, accommodates the recording material. The recording material sensor SA which is an example of a detecting member detects the presence or absence of the recording material in the recording material cassette 160A.

(Automatic Cassette Change Control)

Figure 4:
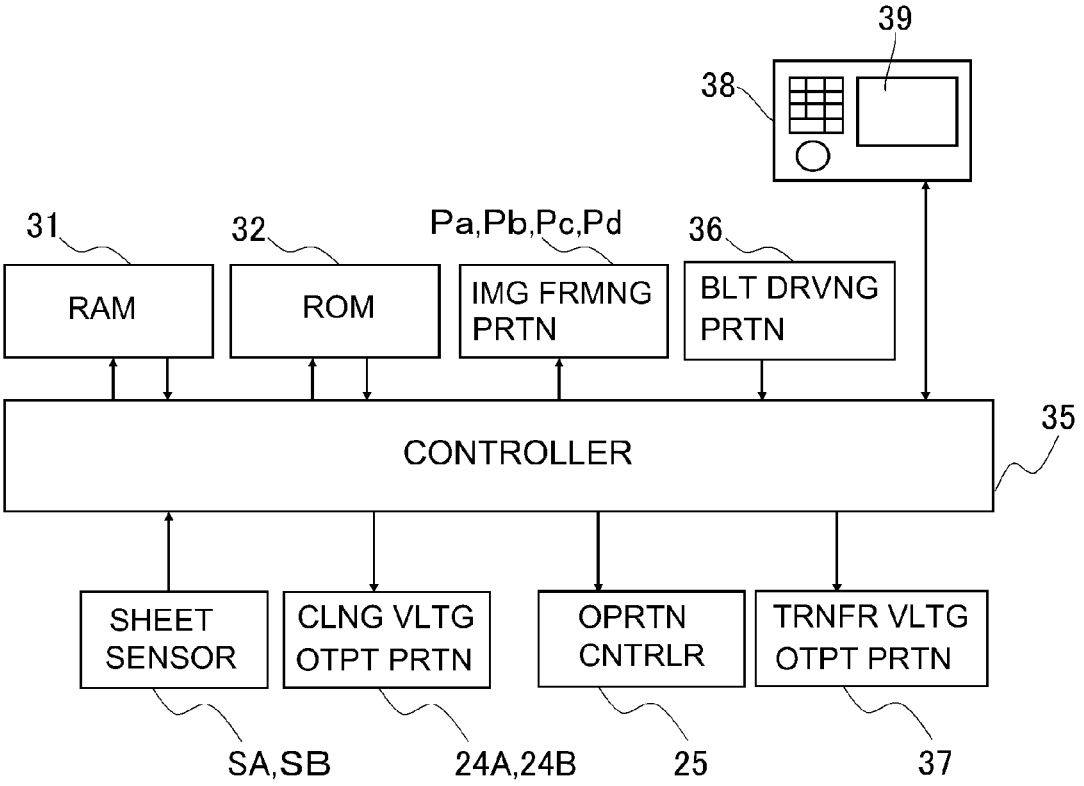
FIG. 4 is a block diagram of a control system of the image forming apparatus.
Figure 5:
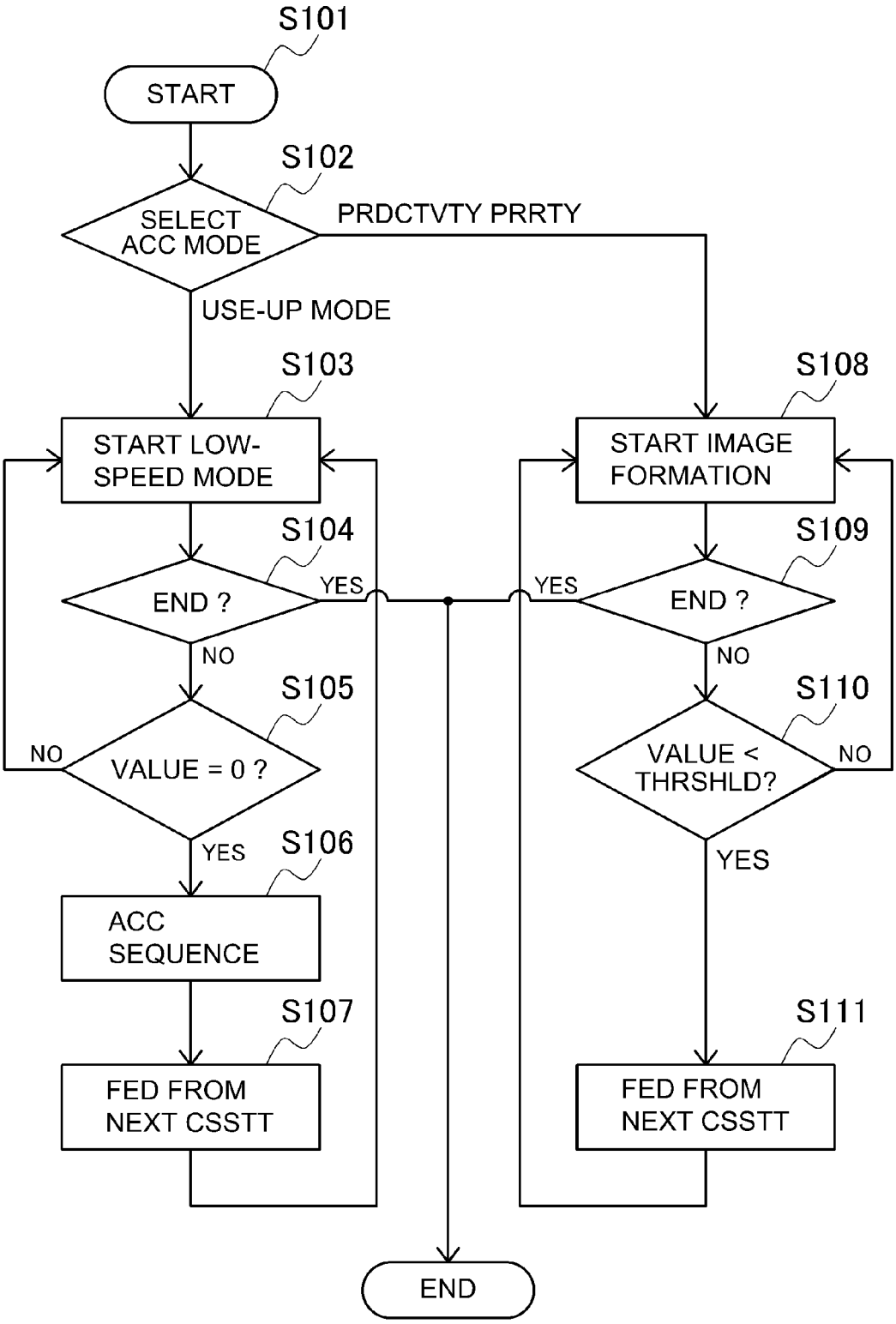
FIG. 5 is a flowchart of auto cassette change control.

FIG. 4 is a block diagram of a control system of the image forming apparatus. FIG. 5 is a flowchart of the automatic cassette change (ACC) control. As shown in FIG. 1, the image forming apparatus 100 executes, during the image formation, an operation in one of a productivity priority mode and a use-up mode. The productivity priority mode and the use-up mode have the following advantages and disadvantages.

(1) Productivity Priority Mode

Before the recording material in the recording material cassette 160A is used up, the feeding of the recording material by the recording material cassette 160B is started, and before the recording material in the recording material cassette 160B is used up, the feeding of the recording material by the recording material cassette 160A is started. The feeding of the recording material by the recording material cassette 160A and the feeding of the recording material by the recording material cassette 160B are seamlessly continued at the same interval, but several to several tens of sheets of the recording material remain in each of the recording material cassettes 160A and 160B.

(2) Use-Up Mode

After the recording material in the recording material cassette 160A is used up, the feeding of the recording material by the recording material cassette 160B is started, and after the recording material in the recording material cassette 160B is used up, the feeding of the recording material by the recording material cassette 160A is started. Each of the recording material cassettes 160A and 160B can be replenished with the recording material in an empty state, but the toner image on the intermediary transfer belt 181 is removed and therefore the downtime occurs.

The controller 35 executes the operation in a low speed mode in the case where the recording material is thicker paper, the operation in a medium speed mode in the case where the recording material is normal thick paper, and the operation in a high speed mode in the case where the recording material is plain paper or thin paper. With a larger weight per unit area of the recording material, heat capacity is larger and a heat load in the fixing device 165 is larger, and therefore there is a need to lower a recording material speed when the recording material passes through the fixing device 165. During the image formation on the thick paper, heat in the fixing device 165 is taken by the recording material to lower a toner heating temperature, so that an image fixing property lowers and therefore an image forming speed lowers. The recording material feeding speed in the fixing device 165 equals to the image forming speed which is the rotational speed of the photosensitive drum and the intermediary transfer belt in the image forming apparatus 100. Table 1 is a list of a relationship between a basis weight (weight unit area) of the recording material and the image forming speed.

TABLE 1

| | | PP*1 | TP1*2 | TP2*3 |
|---|---|---|---|---|
| Basis weight ($g/m^2$) | | 60-200 | 201-250 | 251-350 |
| Image | 300 mm/sec | ○ | — | — |
| Forming | 200 mm/sec | — | ○ | — |
| Speed | 150 mm/sec | — | — | ○ |

*1"PP" is the plain paper.
*2"TP1" is thick paper 1.
*3"TP2" is thick paper 2.

As shown in Table 1, in the image forming apparatus 100, three levels of the image forming speed are provided depending on the basis weight of the recording material as follows.

(1) Low Speed Mode

This mode is applied to the recording material 251-350 $g/m^2$ in basis weight and the image forming speed is 150 mm/sec.

(2) Medium Speed Mode

This mode is applied to the recording material 201-250 $g/m^2$ in basis weight and the image forming speed is 200 mm/sec.

(3) High Speed Mode

This mode is applied to the recording material of 60-200 $g/m^2$ in basis weight and the image forming speed is 300 mm/sec.

As shown in FIG. 5 with reference to FIG. 4, the controller 35 executes the operation in the automatic cassette change (ACC) mode.

When image forming data is received, the controller 35 stores, in RAM 31, the species of the recording material, the basis weight (weight per unit area) of the recording material, the number of sheets outputted for the image and the ACC mode which are set by a user or an operator (S101).

The controller 35 stores, in the RAM 31, the species of the recording material mode designated by the user, and then determines a corresponding recording material mode (S102). When the use-up mode is set (Use-up mode in S102), after the recording material in the recording material cassette 160A is used up, the use of the recording material in the recording material cassette 160B is started.

The controller 35 stores, in the RAM 31, the species of the recording material designated by the user and determines a corresponding image forming speed. The controller executes the image formation in the operation in the low speed mode when the thick paper is set as the recording material (S103). In the operation in the low speed mode, the controller 35 is capable of controlling the image forming portions Pa, Pb, Pc and Pd and the intermediary transfer belt driving portion 36 at the image forming speed of 150 mm/sec.

When the image formation is not ended (NO of S104), at the time when the recording material sensor SA detects that the remaining sheet number in the recording material cassette 160A is 0 (YES of S105), the controller 35 executes a cleaning operation at an increased speed (S106). The controller 35 increases the rotational speed of the intermediary transfer belt 181 from 150 mm/sec to 300 mm/sec, and controls the image forming portions Pa, Pb, Pc and Pd and the intermediary transfer belt driving portion 36.

At the time when the cleaning polarity by the photosensitive drums 101*a*, 101*b*, 101*c* and 101*d* is performed through one full circumference of the intermediary transfer belt 181, the controller 35 starts a recording material feeding operation by the recording material cassette 160B (S107).

The controller 35 executes an operation in a switching mode in a state in which all the recording materials in the recording material cassette 160A are used up, and thereafter warning to the effect that there is no recording material in the recording material cassette 160A is displayed on a display portion 39 of an operating panel 38. In response to the warning, the user replenishes the blank recording material cassette 160A with the recording material.

On the other hand, when the productivity priority mode is set (Productivity priority mode of S102), the controller 35 starts the image formation (S108). When the image formation is not ended (NO of S109), until the remaining sheet number in the recording material cassette 160A detected by the recording material sensor SA is below a threshold (NO of S110), the controller 35 continues the feeding of the recording material by the recording material cassette 160A (S108). Then, at the time when the remaining amount in the recording material cassette 160A detected by the recording material sensor SA is below the threshold (YES of S110), the controller 35 starts the feeding of the recording material by the recording material cassette 160B (5111). When the image formation is ended (YES of S104, YES of S109), the controller 35 ends the image formation.

(Switching Mode in One-Side Printing Mode)

Figure 6:
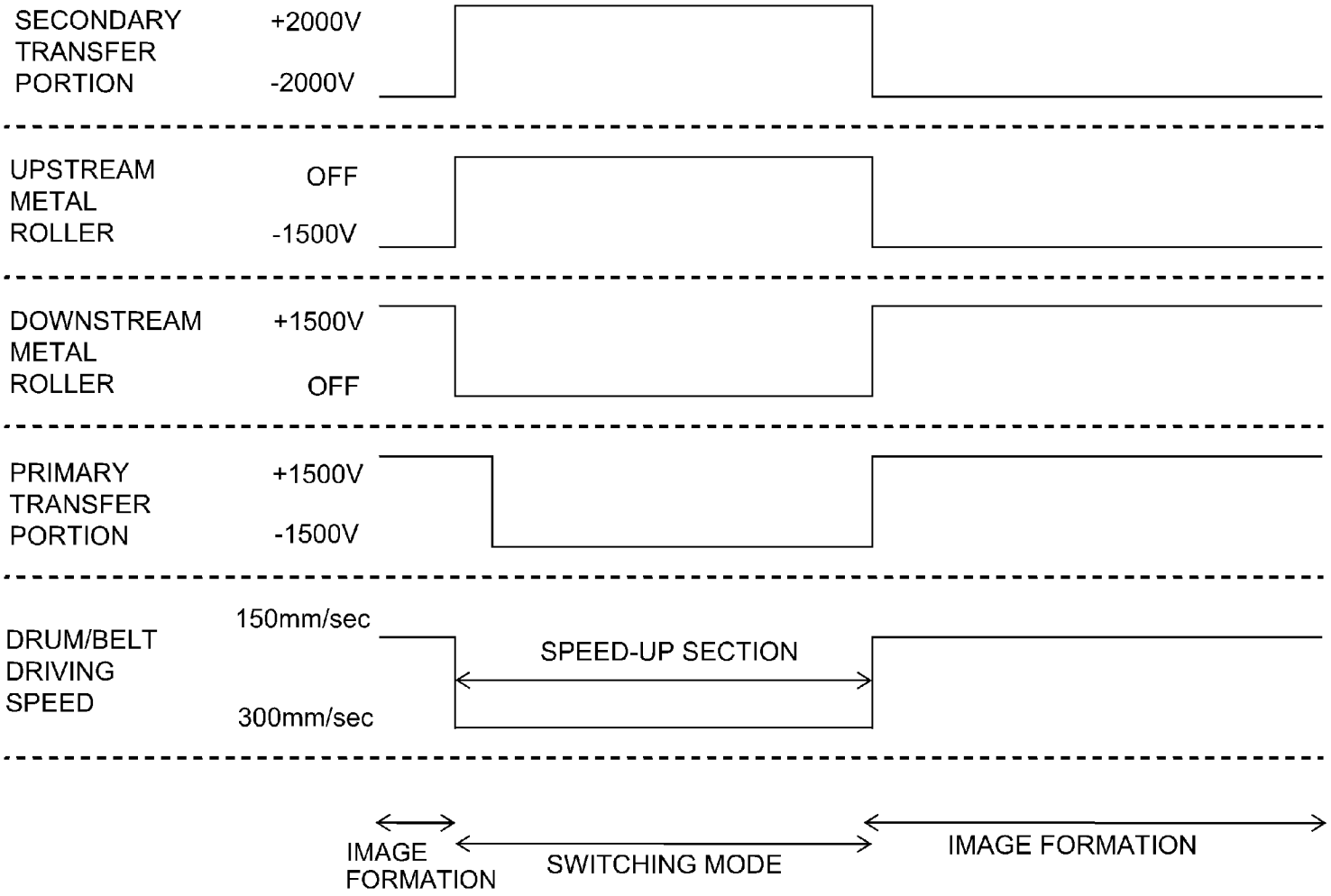

FIG. 6 is a time chart of control in which the operation in the use-up mode is executed in the one-side printing mode. As shown in FIG. 6 with reference to FIG. 1, the image forming speed during the image formation is 150 mm/sec since the recording material is the thick paper. The DC voltage of +1500 V is applied to the primary transfer rollers 124*a*, 124*b*, 124*c* and 124*d*, so that the toner images are transferred from the photosensitive drums 101*a*, 101*b*, 101*c* and 101*d* onto the intermediary transfer belt 181. The DC voltage of −2000 V is applied to the secondary transfer inner roller 129, so that the toner images are transferred from the intermediary transfer belt 181 onto the recording material.

The DC voltage of −1500 V is applied to the upstream metal roller 119B of the belt cleaning device 116, and therefore the upstream fur brush 118B collects the positively charged transfer residual toner on the intermediary transfer belt 181. The DC voltage of +1500 V is applied to the downstream metal roller 119A, and therefore the downstream fur brush 118A collects the negatively charged transfer residual toner on the intermediary transfer belt 181.

When the recording material in the recording material cassette 160A is used up and the sequence enters an operation in a switching mode, the controller 35 stops the toner image formation and transfer at the image forming portions Pa, Pb, Pc and Pd and then increases the image forming speed from 150 mm/sec to 300 mm/sec.

In the operation in the switching mode, the voltage applied to the secondary transfer inner roller 129 is changed from −2000 V to +2000 V opposite in polarity to the voltage of −2000 V. The polarity of the voltage applied to the secondary transfer inner roller 129 is reversed from that during the image formation, so that direct transfer of the toner image from the intermediary transfer belt 181 onto the secondary transfer roller 140 is avoided. By applying the positive-polarity voltage to the secondary transfer inner roller 129, the toner image on the intermediary transfer belt 181 passes through the secondary transfer portion without stopping and remains on the intermediary transfer belt 181.

The controller 35 turns off the voltage application to the upstream metal roller 119A and the downstream metal roller 119B in a period in which the toner image on the intermediary transfer belt 181 passes through the belt cleaning device 116. By turning off the voltage application to the metal rollers 119A and 119B, the toner image on the intermediary transfer belt 181 passes through the belt cleaning device 116 without being collected by the upstream fur brush 118A and the downstream fur brush 118B.

The controller 35 switches the voltage applied to the primary transfer rollers 124*a*, 124*b*, 124*c* and 124*d* to the voltage of −1500 V opposite in polarity to that during the image formation, in a period in which the toner image on the intermediary transfer belt 181 passes through the image forming portions Pa, Pb, Pc and Pd. By applying the voltage opposite in polarity to that during the image formation, the toner images on the intermediary transfer belt 181 are returned to the photosensitive drums 101*a*, 101*b*, 101*c* and 101*d*, and then are collected by the drum cleaning devices 112*a*, 112*b*, 112*c* and 112*d*.

In this embodiment, the toner images are successively collected by the photosensitive drums 101*a*, 101*b*, 101*c* and 101*d*, and therefore only by moving the intermediary transfer belt 181 through one full circumference, it was confirmed that the toner images remaining on the intermediary transfer belt 181 are substantially removed completely.

In order to equalize the toner collecting amount by the photosensitive drums 101*a*, 101*b*, 101*c* and 101*d*, the voltage applied to the primary transfer rollers 124*a*, 124*b*, 124*c* and 124*d* may also be higher at a portion closer to a downstream side. It would be considered that such a pattern that the voltage of 1000 V is applied to the primary transfer rollers 124*a* and 124*b* and the voltage of 1500 V is applied to the primary transfer rollers 124*c* and 124*d* is employed.

The controller 35 removes an operating condition to an original operating condition during the image formation after the intermediary transfer belt 181 moves through one full circumference. The applied voltage to the primary transfer rollers 124*a*, 124*b*, 124*c* and 124*d* is returned to +1500 V, and the applied voltage to the secondary transfer roller 129 is returned to −2000 V. The applied voltages to the upstream and downstream metal rollers 119A and 119B are returned to the original voltages during the image formation, so that an uncollected toner remaining on the intermediary transfer belt 181 in a slight amount is collected by the belt cleaning device 116.

At the time when the intermediary transfer belt 181 passes through the belt cleaning device 116 through one full circumference, the controller 35 decreases the image forming speed from 300 mm/sec to the original image forming speed of 150 mm/sec during the image formation. The controller 35 controls a recording material cassette operation controller 25 to start the feeding of the recording material by the recording material cassette 160B, so that the image formation on the recording material fed from the recording material cassette 160B is started.

(Switching Mode in Double-Side Printing Mode)

FIG. 7 is a time chart of control for executing an operation in the use-up mode in the double-side printing mode.

As shown in FIG. 7 with reference to FIG. 1, during double-side printing the images to be formed on a first (front) surface and a second (back) surface of the recording material are formed on the intermediary transfer belt 181. For this reason, in the operation in the double-side printing mode, at the time when the recording material sensor SA detects no recording material in the recording material cassette 160A, there are several sheets of the recording material, on which the image formation on the first surface is completed, in the reverse feeding path 166 and the feeding path 167 for the double-side printing.

In the case where the recording material remains in the reverse feeding path 166 and the feeding path 167 even when the operation in the switching mode is started, the controller 35 maintains the image forming speed at 150 mm/sec to give high priority to completion of image output of the remaining recording material. The controller 35 applies the voltage of −2000 V to the secondary transfer inner roller 129 when the toner image for the second surface on the intermediary transfer belt 181 passes through the secondary transfer portion T2, so that the toner image is transferred onto the recording material fed from the feeding path 167. When the toner image for the first surface on the intermediary transfer belt 181 passes through the secondary transfer portion T2, the opposite-polarity voltage of +2000 V is applied to the secondary transfer inner roller 129, so that the toner image transfer on the secondary transfer roller 140 is avoided.

By selectively performing the toner image transfer and passing as described above, all of the image formation on the recording materials remaining in the reverse feeding path 166 and the feeding path 167 for the double-side printing is completed. Then, after the final toner image to be formed on the second surface is transferred, the image forming speed is increased from 150 mm/sec to 300 mm/sec.

However, also during the selective toner image transfer and passing, the toner image slipped through the secondary transfer portion T2 on the intermediary transfer belt 181 is needed to be collected by the photosensitive drums 101*a*, 101*b*, 101*c* and 101*d* after being passed through the belt cleaning device 116. For that reason, the controller 35 turns off the voltage application to the metal rollers of the belt cleaning device 116 at timing similar to the timing in the one-side printing mode, and applies the voltage of −1500 V to the primary transfer rollers 124*a*, 124*b*, 124*c* and 124*d*.

The controller 35 returns the applied voltage to the primary transfer rollers 124*a*, 124*b*, 124*c* and 124*d* to the voltage of 1500 V during the image formation. The controller 35 returns the applied voltage to the secondary transfer inner roller 129 to the voltage of −2000 V during the image formation. The controller 35 also returns the applied voltages to the metal rollers of the belt cleaning device 116 to the voltages during the image formation to collect the toner remaining on the intermediary transfer belt 181 in a slight amount. Then, the controller 35 starts the image formation effected by feeding the recording material from the recording material cassette 160B.

Comparison Examples

In Comparison Example 1, when an amount of the recording material in the first recording material cassette 160A is below a predetermined threshold in the image forming apparatus 100, an interval of toner images formed on the photosensitive drum 101*a* is increased. As a result, the recording material fed from the next recording material cassette 160B can reach the secondary transfer portion T2 earlier than the toner image. However, in Comparison Example 1, the toner image interval is increased, so that the downtime which does not contribute to the image formation increases and thus overall productivity of the image forming apparatus 100 lowers.

In Comparison Example 2, in the case where the paper end (no recording material) in the recording material cassette 160A is detected, the intermediary transfer belt 181 on which the toner image is carried is idled by spacing the second transfer roller 140 therefrom, so that a time until the recording material is fed from the next recording material cassette 160B is ensured. However, in Comparison Example 2, there is a possibility that the toner image is disturbed during the idling of the intermediary transfer belt 181 and thus the image defect occurs.

In Comparison Example 3, at the time when the remaining amount of the recording material cassette 160A is below the predetermined threshold, the feeding of the recording material from the recording material cassette 160B is started so that the recording materials can be fed to the secondary transfer portion T2 at regular intervals. In Comparison Example 3, different from Comparison Example 1, the downtime can be avoided but several sheets of the recording material remain in the recording material cassette 160A and therefore such a problem that the recording material is useless or is mixed with another species of the recording material subsequently accommodated in the recording material cassette 160A occurs (the above-described productivity priority mode).

In Comparison Example 4, the toner images are formed at regular intervals in the image forming portions Pa, Pb, Pc and Pd and are transferred onto the intermediary transfer belt 181, and the recording material cassette is switched from the recording material cassette 160A to the recording material cassette 160B after the recording material in the recording material cassette 160A is used up and then the feeding of the recording material from the recording material cassette 160B is started. Then, the toner image which cannot be transferred from the intermediary transfer belt 181 onto the recording material by the switching to the recording material cassette 160B is passed through the secondary transfer portion T2 and is collected by the belt cleaning device 116 or the like in a state in which the toner image formation is stopped.

However, in this method, a time required for collecting the toner image by rotating the intermediary transfer belt 181 in the state in which the toner image formation is stopped is the downtime of the image forming apparatus 100. Particularly, in the case where the image is formed on the thick paper (recording material), a thermal load in the fixing device 165 is large, and therefore the recording material feeding speed and the rotational speed of the intermediary transfer belt 181 is lowered to a fraction of those in the case of the plain paper. For this reason, the downtime needed to remove the toner image by rotating the intermediary transfer belt 181 is increased to several times the downtime in the case of the plain paper.

(Effect of Embodiment 1)

A required time for the operation in the switching mode in the one-side printing mode in the image forming apparatus 100 was compared between the case where the operation is performed at the same image forming speed as that during the image formation and the case where the operation is performed at an image forming speed higher than that during the image formation.

TABLE 2

| | PP*1 | | TP1*2 | | TP2*3 | |
|---|---|---|---|---|---|---|
| BW*4 (g/m$^2$) | 60-200 | | 201-250 | | 251-300 | |
| IMF*5 | OS | DS | OS | DS | OS | DS |
| COMP.EX. 4 | 10 | 10 | 20 | 20 | 30 | 30 |
| EMB. 1 | 10 | 10 | 12 | 14 | 12 | 14 |
| ST*6 | 0 | 0 | 8 | 6 | 18 | 16 |

*1"PP" is the plain paper.
*2"TP1" is the thick paper 1.
*3"TP2" is the thick paper 2.
*4"BW" is the basis weight of the recording material.
*5"IFM" is the image forming mode. "OS" is the one-side printing mode, an "DS" is the double-side printing mode.
*6"ST" is a shortened time.

As shown in Table 2, by increasing the image forming speed during the operation in a low speed mode using the thick paper, the required time for one operation in the switching mode was able to be shortened. By the shortening of the time in the operation in the switching mode, it became possible to improve the productivity of the image forming apparatus 100.

As described above, in Embodiment 1, in the case where the recording material sensor SA detects no recording material during the job for continuously forming the image on the recording material fed from the recording material cassette 160A, the controller 35 which is an example of an executing portion executes the removing operation in the switching mode. After the operation in the switching mode, the image is formed on the recording material fed from the recording material cassette 160B in place of the recording material cassette 160A. The recording material is fed from the recording material cassette 160B after the recording material in the recording material cassette 160A is used up, and therefore co-presence of the recording materials different in species in the recording material cassette 160A is prevented.

In the operation in the switching mode, the image formation is once interrupted and then the toner image which has already been transferred on the intermediary transfer belt 181 is removed from the intermediary transfer belt 181. Different from Comparison Example 1, the interval of the image formation is not increased, and therefore the image formation can be continued until the final recording material with high productivity.

The moving speed of the intermediary transfer belt 181 during the execution of the removing operation is higher than the moving speed of the intermediary transfer belt 181 when the toner image is transferred onto the recording material. For this reason, even in the case where the image formation is executed at a low speed, the cleaning of the intermediary transfer belt 181 can be quickly ended and thus it is possible to start the image formation using the recording material cassette 160B.

In Embodiment 1, when the automatic cassette change is performed, in a period until the image formation is effected after no recording material is detected and the recording material cassette is switched, driving speeds of the photosensitive drums, the intermediary transfer belt and the like are made higher than those during the image formation. For this reason, the downtime during the automatic cassette change is shortened.

In the removing operation in the switching mode, when the toner image is transferred onto the intermediary transfer belt 181, by applying the opposite-polarity voltage to the primary transfer portion T1, the toner image transferred on the intermediary transfer belt 181 is returned to the toner image forming unit. For this reason, even in the case where the toner in a large amount which cannot be collected by the fur brushes 118A and 118B is deposited on the intermediary transfer belt 181, the toner can be efficiently collected in a reverse manner to that in the primary transfer. It is possible to collect the toner onto the photosensitive drum 101*a* with high efficiency without imposing a large cleaning load on the belt cleaning device 116.

In the removing operation in the switching mode, when the toner image transferred on the intermediary transfer belt 181 passes through the secondary transfer portion T1, the voltage of the output opposite to the polarity of the voltage for transferring the toner image onto the recording material is applied to the secondary transfer roller 140. For this reason, it is possible to avoid generation of back surface contamination of the recording material caused by transfer of the toner, passing through the secondary transfer portion T2, onto the secondary transfer roller 140. Unnecessary electric discharge is prevented from acting on the toner passing through the secondary transfer portion T2, and therefore it is possible to efficiently transfer the toner image in a reverse direction at the primary transfer portion T1.

During the removing operation in the switching mode, the voltage of 0 V which is an example of a smaller voltage in absolute value than the voltage when the toner image is transferred onto the intermediary transfer belt 181 is applied to the fur brushes 118A and 118B. As a result, the toner transfer onto the fur brushes 118A and 118B is suppressed, so that a cleaning performance of the belt cleaning device 116 during the resumption of the image formation can be ensured at a high level. There is no phenomenon that the fur brush 118A catches a large amount of the toner to impair the cleaning performance. The unnecessary electric discharge acting on the toner on the intermediary transfer belt is avoided, so that the toner can be transferred onto the photosensitive drum 101*a* at the primary transfer polarity T1 with high efficiency.

The controller 35 which is an example of a changing portion is capable of changing, depending on the species of the recording material, the moving speed of the intermediary transfer belt 181 at a plurality of levels when the toner image is transferred from the image forming portion Pa onto the intermediary transfer belt 181. The moving speed of the intermediary transfer belt 181 during the execution of the removing operation in the switching mode is not less than the maximum speed of the moving speeds of the plurality of levels. This is because a removing operation time is shorter at a higher moving speed. Particularly in the case of the maximum speed, deformation and vibration of the cleaning blade are avoided with reliability, and independently of the speed during the image formation, the cleaning of the intermediary transfer belt 181 can be ended in a certain time.

In the feeding path 167 which is an example of a stand-by portion, the recording material on which the toner image is transferred on the first surface at the secondary transfer portion T2 and then is fixed by the fixing device 165 is on stand-by for formation of the image also on the second surface of the recording material on which the image is formed on the first surface, and then is fed to the secondary transfer portion T2. In the case of the double-side printing mode, the image formation is once interrupted and the recording material is fed through the feeding path 167 and then a part of the toner image transferred on the intermediary transfer belt 181 is transferred onto the second surface of the recording material, and thereafter the removing operation is performed. For this reason, an amount of the toner image, transferred on the intermediary transfer belt 181, collected by the photosensitive drum 101*a* is decreased.

According to Embodiment 1, the automatic cassette change is made in the state in which all the recording material in the recording material cassette 160A is used up, and thereafter the controller 35 provides warning of no recording material in the recording material cassette 160A, so that the user can replenish the recording material in the recording material cassette 160A.

According to Embodiment 1, the time required for the operation in the switching mode with the automatic cassette change in the operation in the use-up mode can be shortened, so that it becomes possible to improve the productivity of the image forming apparatus 100.

In a high-speed machine of the image forming apparatus for which high productivity is required, the downtime during the automatic cassette change is a problem to be avoided for the user to the possible extent since such a phenomenon lowers productivity. Particularly, during the image formation on the thick paper, from the viewpoint of the fixing property, the image forming speed is made slower than that during the image formation on the plain paper, and therefore the downtime during the automatic cassette change further becomes long.

Embodiment 2

In Embodiment 1, in the case where the operation in the switching mode is performed when the operation in the low speed mode in which the recording material is the thick paper is performed, the rotational speeds of the photosensitive drums and the intermediary transfer belt are increased to the same speeds as those during the passing of the thin paper, so that the down sequence time was shortened. On the other hand, in Embodiment 2, the rotational speeds in the operation in the switching mode are increased in the operation in the low speed mode in which the recording material is not only the thick paper but also the thin paper, so that further improvement in productivity is realized.

The rotational speed of the photosensitive drums and the intermediary transfer belt during the operation in the switching mode is 400 mm/sec. The image formation is not effected during the operation in the switching mode, and therefore it is possible to set the rotational speed of the photosensitive drums and the intermediary transfer belt at a desired speed. The image forming speed is settable at the three levels similarly as in Embodiment 1.

At each of the basis weights, the image forming speed, a shortened time of the down sequence time when the operation in the switching mode is performed at the rotational speed of 400 mm/sec are shown in Table 3. By increasing the rotational speed compared with that during the image formation, the productivity can be further improved. In this embodiment, the case of the rotational speed of 400 mm/sec was described, but it is possible to further increase the rotational speed, so that further improvement in productivity can be realized in proportion to the rotational speed.

TABLE 3

| | PP*1 | | TP1*2 | | TP2*3 | |
|---|---|---|---|---|---|---|
| BW*4 (g/m$^2$) | 60-200 | | 201-250 | | 251-300 | |
| IMF*5 | OS | DS | OS | DS | OS | DS |
| IFS*6 (mm/sec) | 300 | | 200 | | 150 | |
| IRS*7 (mm/sec) | 400 | | 400 | | 400 | |
| COMP.EX. 4 | 10 | 10 | 20 | 20 | 30 | 30 |
| EMB. 1 | 7 | 8 | 9 | 11 | 9 | 11 |
| ST*8 | 3 | 2 | 11 | 9 | 21 | 19 |

*1"PP" is the plain paper.
*2"TP1" is the thick paper 1.
*3"TP2" is the thick paper 2.
*4"BW" is the basis weight of the recording material.
*5"IFM" is the image forming mode. "OS" is the one-side printing mode, an "DS" is the double-side printing mode.
*6"IFS" is the image forming speed.
*7"IRS" is the increased rotational speed.
*8"ST" is the shortened time.

In Embodiment 2, the driving (rotational) speed of the intermediary transfer belt is made higher than that during the image formation in the period, when the automatic cassette change is performed, from the detection of no recording material to the time when the image formation is started after the recording material cassette is switched. When the feeding operation of the recording material is automatically changed from that for the recording material cassette in use to that for the next recording material cassette, the rotational speed of the photosensitive drums and the intermediary transfer belt is made higher than that during the image formation in the period until the image formation is started after the recording material cassette is switched.

For this reason, the productivity is improved in a high-speed machine requiring high productivity. The downtime during the automatic cassette change is avoided, so that such a phenomenon that the productivity lowers can be prevented from generating to the possible extent. Particularly, during the image formation on the thick paper, in the case where the image forming speed is made slower than that for the plain paper from the viewpoint of the fixing property, the downtime of the automatic cassette change is prevented from further becoming long.

Modified Embodiments

The present invention can also be carried out in other embodiments in which a part or all of constituent elements in Embodiments 1 and 2 are replaced with alternative constituent elements thereof. In Embodiment 1, only principal portions relating to the toner image formation/transfer were described, but the present invention can be carried out in various uses such as printers, various printing machines, copying machines, facsimile machines and multi-function machines by adding necessary device, equipment and casing structure.

In Embodiment 1, the embodiment in which the fur brushes were used as the cleaning member for cleaning the intermediary transfer belt during the image formation was described. However, the cleaning member may also be a cleaning roller.

A belt cleaning device, of an electrostatic cleaning type, which is exclusively used for the removing operation in the switching mode and which is provided so as to be contactable to and separable from the intermediary transfer belt may also be disposed. A belt cleaning device for cleaning the intermediary transfer belt in a state in which the cleaning blade is in contact with the intermediary transfer belt may be provided downstream of the secondary transfer portion T2 and upstream of the image forming portion Pa with respect to the movement direction of the intermediary transfer belt 181. In the case where the toner image transferred on the intermediary transfer belt 181 is collected by the cleaning blade, it is possible to remove the large amount of the toner by passing the intermediary transfer belt 181 through the cleaning blade one full circumference, and therefore the removing operation time is short.

The number of the image forming portions can be any number of one or more. When the intermediary transfer belt cleaning is performed after the recording material cassette switching, in order to avoid the transfer of the toner onto the secondary transfer roller, the secondary transfer portion T2 may also be spaced.

While the invention has been described with reference to the structures disclosed herein, it is not confined to the details set forth and this application is intended to cover such modifications or changes as may come within the purpose of the improvements or the scope of the following claims.

This application claims the benefit of Japanese Patent Application No. 2014-104901 filed on May 21, 2014, which is hereby incorporated by reference herein in its entirety.

What is claimed is:

1. An image forming apparatus comprising:

a movable intermediary transfer member onto which a toner image to be transferred onto a recording material is once transferred;

first and second accommodating portions for accommodating recording materials;

a detecting member for detecting a recording material in said first accommodating portion;

an executing portion for executing a removing operation for removing the toner image transferred on said intermediary transfer member by once interrupting a continuous job for continuously forming an image on recording materials fed from said first accommodating portion when a discrimination that there is no recording material in said first accommodating portion is made on the basis of a detection result of said detecting member during the continuous job and then for executing a switching operation for resuming the continuous job by feeding a recording material from said second accommodating portion; and a setting portion for setting a moving speed of said intermediary transfer member during execution of the removing operation so as to be higher than a moving speed of said intermediary transfer member when the toner image is transferred onto the recording material.

2. An image forming apparatus according to claim 1, wherein said setting portion sets the moving speed of said intermediary transfer member during execution of the removing operation at not less than a maximum speed of moving speeds of a plurality of levels executable when the toner image is transferred onto said intermediary transfer member.

3. An image forming apparatus according to claim 1, further comprising:

a first transfer member for transferring the toner image from said intermediary transfer member onto the recording material; and a cleaning member for removing the toner image from said intermediary transfer member, wherein said cleaning member is provided downstream of said first transfer member and upstream of a toner image forming unit with respect to a movement direction of said intermediary transfer member and is disposed so as to be contactable to and separable from said intermediary transfer member, wherein said executing portion brings said cleaning member into contact with said intermediary transfer member during the removing operation to remove the toner image transferred on said intermediary transfer member.

4. An image forming apparatus according to claim 1, further comprising:

a toner image forming unit; and a second transfer member for transferring the toner image from said toner image forming unit onto said intermediary transfer member, wherein said executing portion applies, to said second transfer member during the removing operation, a voltage of a polarity opposite to a polarity of a voltage for transferring the toner image onto the intermediary transfer member.

5. An image forming apparatus according to claim 1, further comprising:

a first transfer member for transferring the toner image from said intermediary transfer member onto the recording material; and a second setting portion for setting a state between said first transfer member and said intermediary transfer member to either one of a contact state and a spaced state, wherein said executing portion causes, during the removing operation, said second setting portion to set the state to the spaced state.

6. An image forming apparatus according to claim 1, further comprising:

a first transfer member for transferring the toner image from said intermediary transfer member onto the recording material, wherein said executing portion applies, to said first transfer member during the removing operation, a voltage of a polarity opposite to a polarity of a voltage when the toner image is transferred onto the recording material.

7. An image forming apparatus according to claim 3, wherein said cleaning member is a rotatable brush roller.

8. An image forming apparatus according to claim 7, further comprising:

a power source for applying a cleaning voltage to said brush roller during image formation, wherein said brush roller includes a brush formed of an electroconductive substance, and wherein said executing portion sets, during the removing operation, the voltage applied to said brush roller to a voltage having a lower absolute value than the cleaning voltage.

* * * * *